US006886888B2

(12) United States Patent
Bock

(10) Patent No.: US 6,886,888 B2
(45) Date of Patent: May 3, 2005

(54) SYNCHRONIZING MECHANISM FOR CORRELATED SEAT/BACKREST MOTION OF AN OFFICE CHAIR

(75) Inventor: Hermann Bock, Pyrbaum (DE)

(73) Assignee: Bock-1 GmbH & Co., Postbauer-Heng (DE)

( * ) Notice: Subject to any disclaimer, the term of this patent is extended or adjusted under 35 U.S.C. 154(b) by 0 days.

(21) Appl. No.: 10/147,033

(22) Filed: May 17, 2002

(65) Prior Publication Data

US 2002/0171276 A1 Nov. 21, 2002

(30) Foreign Application Priority Data

May 18, 2001 (DE) ..... 101 25 994

(51) Int. Cl.[7] ..... A47C 1/024
(52) U.S. Cl. ..... 297/300.2
(58) Field of Search ..... 297/300.1, 300.2, 297/300.4, 300.5, 340

(56) References Cited

U.S. PATENT DOCUMENTS 5,150,948 A * 9/1992 Volkle
5,308,144 A 5/1994 Korn
5,354,120 A * 10/1994 Volkle
5,971,481 A 10/1999 Emmenegger et al.
6,238,000 B1 * 5/2001 Hallmark et al.
6,431,649 B1 * 8/2002 Hensel
2001/0024057 A1 * 9/2001 Heidt
2001/0026089 A1 * 10/2001 Insalaco et al.

FOREIGN PATENT DOCUMENTS

FR 2 533 428 3/1984
WO WO 00/22959 4/2000

* cited by examiner

*Primary Examiner*—Milton Nelson, Jr.
(74) *Attorney, Agent, or Firm*—Browdy and Neimark

(57) ABSTRACT

A synchronizing mechanism for correlated seat/backrest motion of an office chair is provided with a base carrier to be placed on a chair column; a seat carrier, which is pivotable about a transverse axis and, at its front end, articulated to the base carrier; and a backrest carrier, which is also pivotable about a transverse axis and articulated to the base carrier. It is coupled with the seat carrier such that a backward pivoting motion of the backrest induces a lowering motion of the rear end of the seat carrier. The joint between the base carrier and the seat carrier is a turning and sliding joint so that the lowering motion of the seat carrier is combined with a horizontal sliding motion.

6 Claims, 3 Drawing Sheets

SYNCHRONIZING MECHANISM FOR CORRELATED SEAT/BACKREST MOTION OF AN OFFICE CHAIR

BACKGROUND OF THE INVENTION

1. Field of the Invention

The invention relates to a synchronizing mechanism for correlated seat/backrest motion of an office chair, comprising a base carrier to be placed on a chair column; a seat carrier, which is pivotable about a transverse axis and, at its front end, articulated to the base carrier; a backrest carrier, which is also pivotable about a transverse axis and articulated to the base carrier and which is coupled with the seat carrier such that a backward pivoting motion of the backrest induces a lowering motion of the rear end of the seat carrier; the backrest carrier being pivotably mounted on the base carrier by a cam arrangement that defines a four-bar chain; the cam arrangement being comprised of front and rear cams that are articulated to the base carrier and of the backrest carrier itself as a coupling of the four-bar chain; and the seat carrier, by its rear end, being articulated to the backrest carrier.

2. Background Art

The term "synchronizing mechanism" means structural components in the substructure of an office chair which provide for kinematics that involve a certain coupled motion of the seat relative to the backrest. Placed on a chair column is a base carrier on which, on the one hand, is mounted a seat carrier which is pivotable about a transverse axis and articulated to the base carrier and, on the other hand, a backrest carrier which is pivotable about a transverse axis and articulated to the base carrier. Mounted on the seat carrier is the seat of the office chair, which is as a rule provided with an upholstered seat panel. Conventionally, the backrest carrier extends backwards from the virtual synchronizing mechanism, supporting the backrest of the office chair on an upward prolongation.

The seat carrier and the backrest carrier are jointed such that pivoting the backrest backwards—caused for instance when someone sitting on the chair leans back against the backrest—induces the rear edge of the seat to be lowered. This correlated seat/backrest motion is quite convenient and desirable for orthopedic reasons.

A frequent problem in prior art synchronizing mechanisms resides in the pivoting angle of the backrest which is often rather restricted. Moreover, very often the lowering motion of the seat panel is not sufficiently great even with a comparatively great pivoting angle of the backrest, which is due to the pivotable mounting of the seat and backrest carrier in a single joint on the base carrier.

In an office chair of the generic type known from DE 199 21 153 A1, the above outlined objects are attained by the backrest carrier being mounted on the base carrier by way of a cam arrangement that defines a four-bar chain. The cam arrangement is comprised of two cams that are articulated to the base carrier and of the backrest carrier itself as a coupling of the four-bar chain. The longitudinal axes of the two cams form an acute angle that opens upwards towards the seat.

Mounting the backrest support in the way of a four-bar chain as mentioned above fundamentally helps achieve a great pivoting angle, with the backrest carrier not only rotating about a fixed pivot axis, but making an additional backward tilting motion. This pronounced rotary tilting motion is rendered possible by the cams opening upwards.

Provision is further made for the front end of the seat carrier to be articulated to the base carrier by another cam. In the upright position of the synchronizing mechanism, this cam inclines forwards. The rear end of the seat carrier is articulated to the backrest carrier.

Due to the arrangement of the front cam inclining forwards, the seat, starting from the upright position of the synchronizing mechanism—i.e. the base position—will perform a pronounced elevating motion by its front edge at least at the beginning of the correlated seat/backrest motion. The effect is that the user, when actuating the synchronizing mechanism by pressing the backrest backwards, must work against her/his own weight on the seat.

Individually varying preferences involve that some individuals will consider this effect a drawback. This also implies the pronounced elevating motion mentioned above of the seat carrier and thus of the seat of an office chair at the beginning of the synchronous seat/backrest motion.

Finally, the articulated mounting of the seat carrier by an overall of three pairs of cams on either side of the longitudinal center plane of the seat is a comparatively complicated construction.

DE 198 10 768 A1 teaches a synchronizing mechanism in which the backrest carrier is articulated to the base carrier in a single point, fulfilling a pure pivoting motion. At its rear end the seat carrier of this synchronizing mechanism is coupled by a point of articulation with the backrest carrier. At its front end it is cam-controlled in an oblong hole that ascends from front to back. The overall construction of this backrest/seat carrier articulation is simple, but its kinematics fail to comply with practice requirements. In particular the ascending oblong hole for cam-controlled mounting of the front end of the seat carrier causes the elevating motion of the seat front edge, which has been mentioned in connection with the construction according to DE 199 21 153 A1.

SUMMARY OF THE INVENTION

Proceeding from the prior art problems, it is an object of the invention to improve a synchronizing mechanism of the generic type in such a way that, accompanied with constructional simplification, the initial elevating motion of the seat carrier is avoided.

According to the invention, this object is attained by the joint between the base carrier and seat carrier at the front end being a turning and sliding joint which is designed for the lowering motion of the seat carrier to be combined with a rearward horizontal sliding motion. Preferably, the turning and sliding joint is a horizontal, oblong-hole-type connecting member in the seat carrier which runs in the longitudinal direction of the seat and has a bearing journal of the seat carrier guided in it.

The design, mentioned at the outset, of the articulated linkage of the seat carrier to the base carrier helps prevent the elevating motion mentioned at the outset, which is accompanied with the desired improvement of ease and convenience. In addition, a turning and sliding joint especially of the type of embodiment outlined at the outset can be put into practice very easily.

Further preferred embodiments that involve the arrangement and dimensioning of the joints and cams of the four-bar chain provided between the base carrier and the backrest carrier and seat carrier serve for obtaining an especially compact design accompanied with an increase in the ratio that the pivoting angle of the backrest bears to the pivoting angle of the seat carrier—as compared to the prior art according to DE 199 21 153 A1.

Finally, the base carrier is rendered especially compact by the outside attachment of the cams and backrest carrier, serving as a central "backbone" of the synchronizing mechanism. The preferred embodiment of the cams in a widened sheet configuration helps create an additional design element while, in terms of industrial safety, reliably preventing a user's fingers from getting stuck in the synchronizing mechanism.

Further features, details and advantages of the invention will become apparent from the ensuing description of an exemplary embodiment of the invention, taken in conjunction with the drawings.

DESCRIPTION OF THE PREFERRED EMBODIMENT

Figure 1:
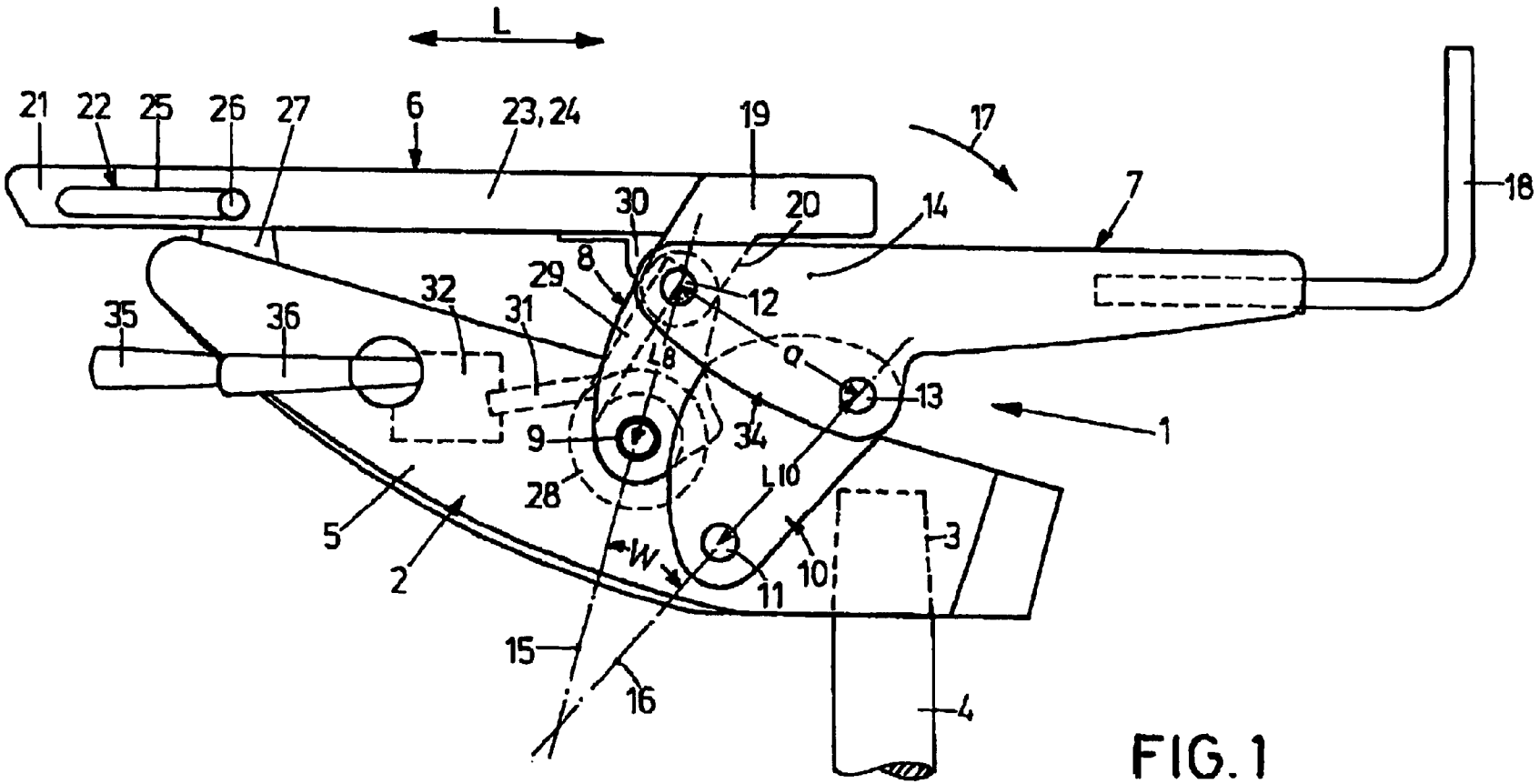
FIG. 1 is a diagrammatic lateral view of the synchronizing mechanism in the normal position.

The fundamental structure of the synchronizing mechanism, which is denoted by 1 in its entirety, will be explained in conjunction with FIGS. 1 and 3. It comprises a base carrier 2 that is placed on the upper end of a chair column 4 by means of a cone receptacle 3. Various constructional elements of the synchronizing mechanism 1 are outside and above the lateral cheeks 5 that run parallel to the longitudinal direction L of the chair. The core pieces thereof are a substantially frame-type seat carrier 6 and a backrest carrier 7 which is forked seen in a plan view. Mounted on the seat carrier 6 is the seat (not shown) with an upholstered seat panel. By way of an elbowed cross arm 18, the backrest carrier 7 holds a backrest (not shown) which is vertically adjustable in today's office chairs.

Figure 3:
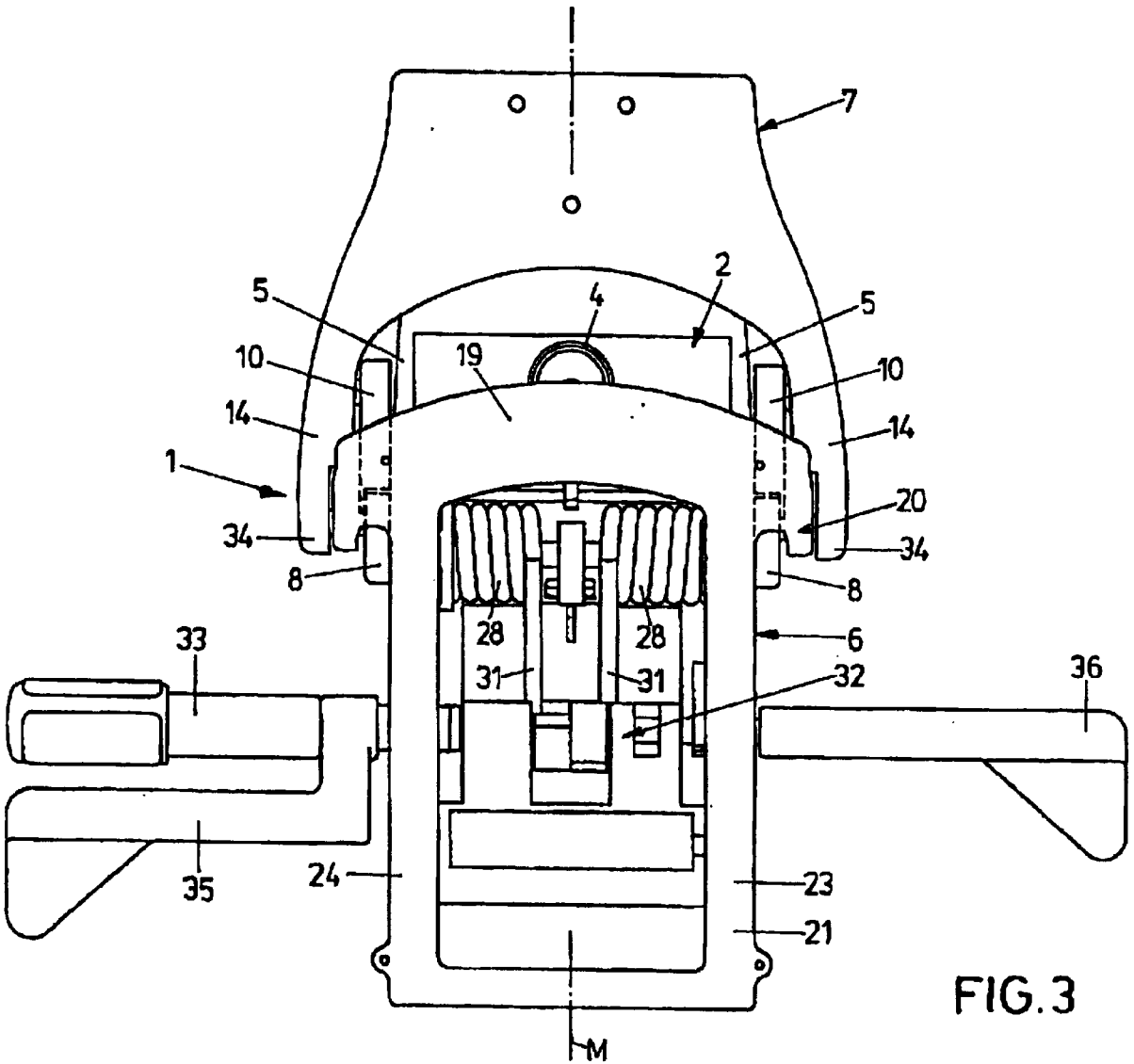
FIG. 3 is a diagrammatic plan view of the synchronizing mechanism according to FIG. 2.

In terms of kinematics, the entire synchronizing mechanism 1 is designed in mirror symmetry to the longitudinal center plane M as seen in particular in FIG. 3. In this regard, the ensuing description regularly proceeds from constructional elements that are available bilaterally in pairs.

The backrest carrier 7 is articulated to the base carrier 2 by way of a cam arrangement. This arrangement comprises a first cam 8 which is articulated approximately centrally to a pivot bearing 9 on the base carrier 2. A second cam 10 is mounted between the front cam 8 and the cone receptacle 3 on a pivot bearing 11 on the base carrier 2, the free ends of the two cams 8, 10 are coupled with the backrest carrier 7 by way of joints 12, 13. The two pivot bearings 9, 11 and the joints 12, 13 define a four-bar chain in which the backrest carrier 7 itself forms the coupling by its respective forked leg 14. In the normal position of the backrest carrier 7 seen in FIG. 1, the front cam 8 is positioned approximately vertically upwards, while the rear cam 10 inclines backwards. In this case, the longitudinal axes 15, 16 of the cams 8, 10 that pass through the points of articulation make an acute angle W (FIG. 1) slightly greater than 30° that opens upwards toward the seat carrier 6. The ratio that the length of the front cam 8 bears to the length of the rear cam 10 is approximately 2.5:3. Owing to this design and the arrangement of the four-bar chain, the backrest carrier 7 makes a combined rotary pivoting motion downward to the rear, which is roughly outlined by the arrow 17 in FIG. 1.

The seat carrier 6 is coupled with the backrest carrier 7 before its rear end 19, via a bearing lug 20, to the axis that forms the front joint 12 as seen in FIG. 1, its rear end thus being linked. Consequently, the joint between the seat carrier 6 and the backrest carrier 7 is integrated into the front joint 12 between the cam 8 and the backrest carrier 7. At its front end 21—which is on the left in FIG. 1—the seat carrier 6 is linked to the base carrier 2 by a turning and sliding joint which is denoted by 22 in its entirety. On the one hand it is comprised of an oblong-hole-type connecting member 25 which is incorporated in the longitudinal legs 23, 24 that are located on both sides; on the other hand a bearing journal 26 engages from inside with the connecting member 25. The bearing journal 26 is molded on a prolongation 27 of the base carrier 2, standing out therefrom at right angles to the longitudinal center plane M and reaching into the connecting member 25.

The synchronizing mechanism 1 is biased by a spring arrangement F counter to the direction of the arrow 17—i.e. towards the normal position of the synchronizing mechanism 1. This spring arrangement F is available in the form of two leg springs 28 (FIG. 3) which are in alignment in the cross direction and positioned around the axis 21 that constitutes the pivot bearing 9 of the front cam 8. The upward leg 29 supports itself on a projection 30 on the seat carrier 6, whereas the second forward leg 31 supports itself on an adjusting mechanism 32 in the base carrier 2. The leg springs 20 exercise spring-loading counter to the backward pivoting motion of the backrest which is variable through the adjusting mechanism 32 by actuation of a turning lever 33.

Figure 2:
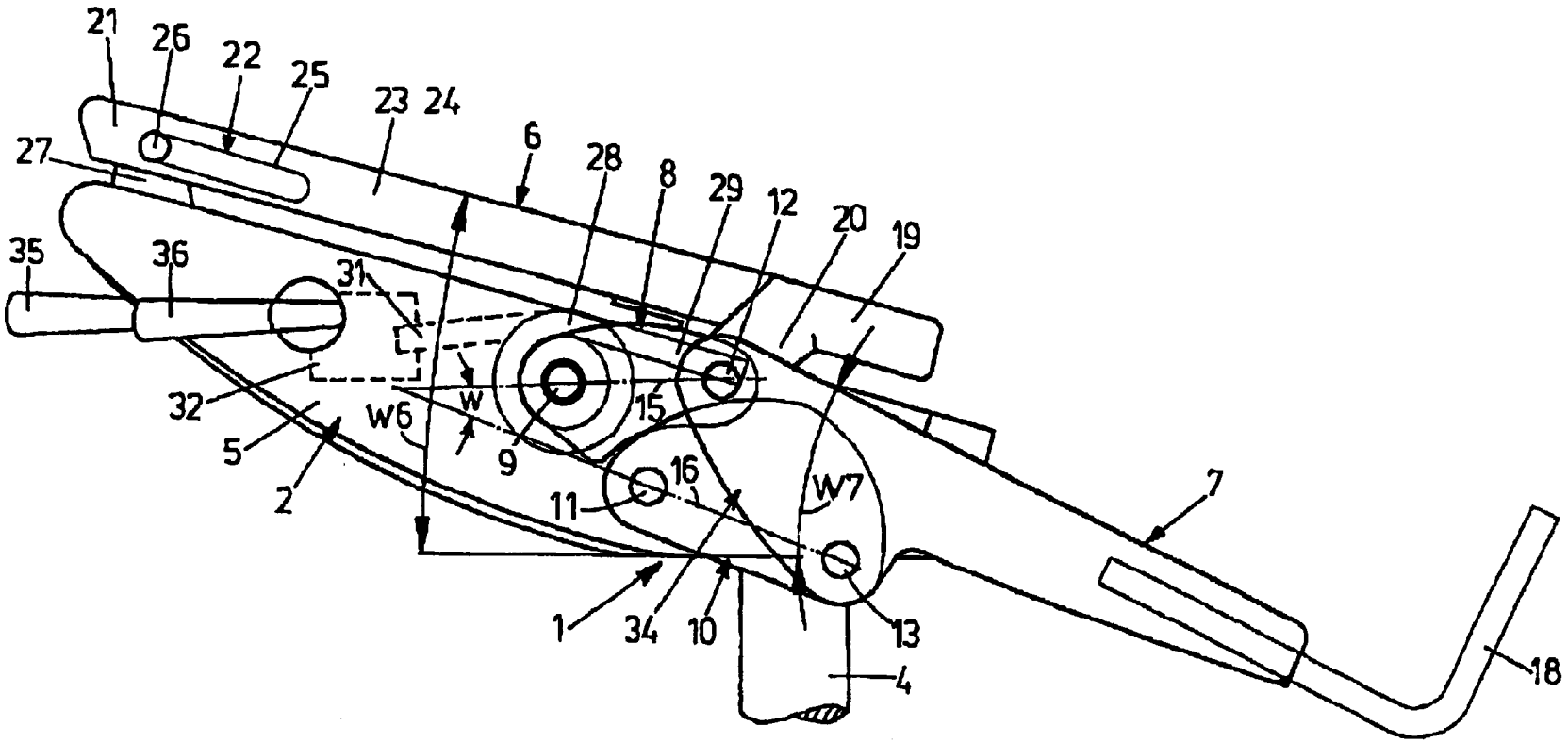
FIG. 2 is a lateral view by analogy to FIG. 1 in a backwards pivoted position of the synchronizing mechanism.

As can be seen from a comparison of FIGS. 1 and 2, the backrest carrier 7, upon actuation of the backrest rearwards, makes the pivoting motion downward to the rear that is roughly outlined by the arrow 17, with the rear cam 10 and the front cam 8 of the four-bar chain also tilting further backwards. In the case of a maximal pivoting angle of the backrest carrier 7, the angle W between the longitudinal axes 15, 16 of the two cams 8, 10 is approximately 20° (FIG. 2). The four-bar chain folds up, as it were compared to the spread initial position according to FIG. 1 so that this quite compact arrangement becomes even smaller.

Another contribution to the compact arrangement resides in that the distance a of the two joints 12, 13 which are located between the backrest carrier 7 and the cams 8 and 10, respectively, is approximately equal to the length L10 of the rear cam 10 and, in the ratio specified above, greater than the length L8 of the front cam 8.

By means of the mentioned pivoting motion of the four-bar chain with the backrest carrier 7, the seat carrier 6 is pivoted downwards to the rear as well as displaced horizontally to the rear in the vicinity of the turning and sliding joint 22. As a result, there is no relevant lift of the front end 21 of the seat panel, which helps avoid constrictions or pressure on the lower side of the thighs.

The synchronizing mechanism 1 is designed in such a way that, in the final position of backward tilt seen in FIG. 2, the backrest carrier 7 passes through a pivoting angle W7 of approximately 26°, while the pivoting angle W6 of the seat carrier 6 is approximately 15°. Noticeably, the backrest carrier to seat carrier pivoting angle ratio changes during the pivoting motion. Initially, the ratio is in the range of approximately 3.5:1, in the middle of the pivoting range it decreases to about 2:1, ultimately reaching a W7 to W6 ratio of approximately 1.8:1 in the position of maximal tilt. This is accompanied with the advantage that a great lowering angle of the seat carrier can be obtained without the pivoting angle of the backrest becoming too great, which would result in a next to prone position. The reason for this low final ratio of the pivoting angles is the sliding motion of the seat carrier during lowering. This also helps to successfully stop the so-called "shirt untucking effect".

As seen in FIGS. 1 and 3, the cams 8, 10, which are attached externally to the seat carrier 6, have an approximately reniform widened sheet configuration, there being overlap of the cams 8, 10 in any position of pivot between the two positions according to FIGS. 1 and 2 and in combination with the bearing cheeks 34 of the forked backrest carrier 7 that apply externally on the cams 8, 10, so that there is no possibility of reach-through between the cams 8, 10, base carrier 2 and backrest carrier 7. In this way, the fingers of someone who sits on the chair are efficiently protected against getting stuck when the synchronizing mechanism is pivoted.

In a manner not shown in detail, the synchronizing mechanism 1 is lockable in various positions between the main position (FIG. 1) and the position of maximal backward tilt (FIG. 2). The figures do not explicitly show the corresponding locking mechanism and there is no need of detailed specification because it is prior art. Attention is only drawn to the fact that locking takes place by means of another operating lever 35 on the side of the turning lever 33. The operating lever 36 on the other side serves for releasing the vertical adjustment of the chair column 4.

What is claimed is:

1. A synchronizing mechanism for correlated seat/backrest motion of an office chair, comprising a base carrier (2) to be placed on a chair column (4); a seat carrier (6), which is pivotable about a transverse axis, and at its front end (21), articulated to the base carrier (2);

a backrest carrier (7), which is also pivotable about a transverse axis and articulated to the base carrier (2) and which is coupled with the seat carrier such that a backward pivoting motion of a backrest induces a lowering motion of a rear end of the seat carrier (6);

the backrest carrier (7) being pivotably mounted on the base carrier (2) by a cam arrangement (8, 10) that defines a four-bar chain;

the cam arrangement (8, 10) being comprised of front and rear cams (8, 10) that are articulated to the base carrier (2) and of the backrest carrier (7) itself as a coupling of the four-bar chain; and the seat carrier (6), by its rear end (19), being articulated to the backrest carrier (7);

wherein the joint between the base carrier (2) and the seat carrier (6) is a turning and sliding joint (22) so that a lowering motion of the seat carrier (6) is combined with a horizontal sliding motion rearwards.

2. A synchronizing mechanism according to claim 1, wherein the turning and sliding joint (22) comprises, in the seat carrier (6), an oblong-hole-type connecting member (25) which extends in a longitudinal direction and in which a bearing journal (26) of the, seat carrier (6) is guided.

3. A synchronizing mechanism according to claim 1 wherein a link between the seat carrier (6) and the backrest carrier (7) is integrated into a front joint (12) between the front cam (8) and the backrest carrier (7).

4. A synchronizing mechanism according to claim 1, wherein a distance (a) of two joints (12, 13) between the backrest carrier (7) and the two cams (8, 10) is approximately equal to a length (L10) of the rear cam (10) and greater than a length (L8) of the front cam (8).

5. A synchronizing mechanism according to claim 1, wherein the cams (8, 10) are mounted externally on the seat carrier (6) with the backrest carrier (7) being attached thereto by way of bearing checks (34) that are applied externally on the cams (8, 10).

6. A synchronizing mechanism according to claim 5, wherein, in a plan view related to their joint axis, the cams (8, 10) have a widened sheet configuration so that in none of the pivoted relative positions of the four-bar chain formed thereby, there is a possibility of reach-through between the cams (8, 10), base carrier (2) and backrest carrier (7).

* * * * *